US009884709B1

(12) United States Patent
Barrett

(10) Patent No.: US 9,884,709 B1
(45) Date of Patent: Feb. 6, 2018

(54) CLOTH BAND TIE CARD APPARATUS AND METHOD

(71) Applicant: JUNK BRANDS COMPANY, LLC, Bentonville, AR (US)

(72) Inventor: Kourtney F. Barrett, Bentonville, AR (US)

(73) Assignee: Junk Brands Company, LLC, Bentonville, AR (US)

( * ) Notice: Subject to any disclaimer, the term of this patent is extended or adjusted under 35 U.S.C. 154(b) by 0 days.

(21) Appl. No.: 15/154,380

(22) Filed: May 13, 2016

Related U.S. Application Data

(60) Provisional application No. 62/162,024, filed on May 15, 2015.

(51) Int. Cl.
*B65D 85/18* (2006.01)
*B65D 73/00* (2006.01)
*B65B 15/02* (2006.01)

(52) U.S. Cl.
CPC ..... *B65D 73/0007* (2013.01); *B65B 15/02* (2013.01)

(58) Field of Classification Search
CPC ... B65D 73/0007; B65D 85/18; B65D 85/182
USPC ..... 206/297; 223/84, 71, 81, 82, 37
See application file for complete search history.

(56) References Cited

U.S. PATENT DOCUMENTS

| | | | | |
|---|---|---|---|---|
| 2,092,253 A * | 9/1937 | Hogan | A47G 25/54 223/71 |
| 4,277,847 A | 7/1981 | Florio | |
| 4,798,293 A * | 1/1989 | Carstens | B65D 85/182 206/292 |
| 5,423,091 A | 6/1995 | Lange | |
| 5,963,989 A | 10/1999 | Robertson | |
| 5,987,647 A | 11/1999 | Ouellette | |
| 6,205,590 B1 | 3/2001 | Gorman | |
| 8,678,250 B2 * | 3/2014 | Williams | A47G 25/20 223/71 |

* cited by examiner

*Primary Examiner* — King M Chu
(74) *Attorney, Agent, or Firm* — Head, Johnson, Kachigian & Wilkinson, PC

(57) ABSTRACT

A tie-on headband positioning device using post and rail separated slots for compact spreading of headband material in a flat configuration providing compacted storage, shipping, and display of the headband. The device is likewise suitable for use with other elongated flexible bands other than headbands, such as scarves, socks, or hose.

22 Claims, 9 Drawing Sheets

CLOTH BAND TIE CARD APPARATUS AND METHOD

CROSS REFERENCE

This is based on and claims priority to U.S. Provisional Application No. 62/162,024 filed May 15, 2015.

BACKGROUND OF THE INVENTION

Field of the Invention

This invention relates to improvements in product packaging, transportation, and display for flexible lengths of material. More particularly, the invention relates to improvements particularly suited for the packaging, transportation, and display of tie on headbands. In particular, the present invention relates specifically to a tie card using apertures to form a post and rail construction for controlling the positioning of a headband.

Description of the Related Art

As will be appreciated by those skilled in the art, headbands, scarves, and other elongated pieces of cloth are known in various forms. From prior references it may be seen that the prior art is very limited in their teaching and utilization, and an improved cloth band tie card and method are needed to overcome these limitations.

Based on the foregoing, it is desirable to provide a display card for elongated flexible bands, such as headbands, that displays the entire band neatly and with minimal damage to the band. It is further desirable for the display card to display the band in a flat manner, minimizing bulk. It is further desirable for the display card to display the band with an ornamental knot, similar to the intended use of the band. It is further desirable for the display card to allow for compact spreading of band material in a doubled elongated flat configuration providing non-wrinkling compacted storage, shipping, and display of the band.

SUMMARY OF THE INVENTION

In general, in a first aspect, the invention relates to a display card for displaying a flexible band, the display card comprising: a front, a back, a top, a bottom, a right side, and a left side; a first side aperture; an upper mid aperture; a second side aperture; a lower mid aperture; a bottom aperture; a first post, where the first post is located between and defined by the first side aperture and the upper mid aperture; a second post, where the second post is located between and defined by the second side aperture and the upper mid aperture; a mid rail, where the mid rail is located between and defined by the upper mid aperture and the lower mid aperture; and a bottom rail, where the bottom rail is located between the lower mid aperture and the bottom.

The first side aperture and the second side aperture may each be vertically elongate and the first side aperture may be parallel to the second side aperture. The first side aperture and the second side aperture may be parallel to the right side and the left side. The first side aperture may be located closer to the left side than to the right side, the second side aperture may be located closer to the right side than to the left side, and the upper mid aperture may be horizontally elongate and located between the first side aperture and the second side aperture, where the upper mid aperture is separated from the first side aperture by the first post and the upper mid aperture is separated from the second side aperture by the second post. The first side aperture, the second side aperture, and the upper mid aperture may be located closer to the top than to the bottom.

The upper mid aperture and the lower mid aperture may each be horizontally elongate and the upper mid aperture may be parallel to the lower mid aperture. The upper mid aperture and the lower mid aperture may be parallel to the top and the bottom. The upper mid aperture may be located closer to the top than to the bottom and the lower mid aperture may be located closer to the bottom than to the top. The upper mid aperture and the lower mid aperture may be centered relative to the right side and the left side.

The display card may further comprise a bottom aperture, where the bottom rail is located between and defined by the lower mid aperture and the bottom aperture. The bottom aperture may be a notch in the bottom. The display card may further comprise a hanging aperture located between the upper mid aperture and the top.

The display card may further comprise the flexible band, where the flexible band is elongate and has a first end, a second end, and a midpoint located midway between the first end and the second end. The midpoint of the flexible band may be located at the bottom, while the flexible band may wrap around the bottom rail, pass through the bottom mid aperture, pass in front of the mid rail, pass through the upper mid aperture, wrap around the first post and the second post, and pass through the first side aperture and the second side aperture. The first end and the second end may be tied in a knot located between the first side aperture and the second side aperture and in front of the upper mid aperture.

In a second aspect, the invention relates to a method of displaying the flexible band on the display card. The method may comprise: passing the first end through the lower mid aperture from back to front; pulling the first end until the midpoint is adjacent the bottom; passing the first end and the second end through the upper mid aperture from front to back; passing the first end through the first side aperture from back to front and passing the second end through the second side aperture from back to front, or passing the first end through the second side aperture from back to front and passing the second end through the first side aperture from back to front; and tying the first end and the second end together.

Passing the first end and the second end through the upper mid aperture from front to back may further comprise pulling the first end and the second end simultaneously until the flexible band is taught and lies flat in front of the mid rail. The method may further comprise placing the first or second end, as appropriate, to the left of the display card prior to passing it through the first side aperture from back to front such that the flexible band folds 90° behind the first post. Similarly, the method may further comprise placing the first or second end, as appropriate, to the right of the display card prior to passing the second end through the second side aperture from back to front such that the flexible band folds 90° behind the second post. Tying the first end and the second end together may comprise forming a square knot in front of the upper mid aperture.

Figure 1:
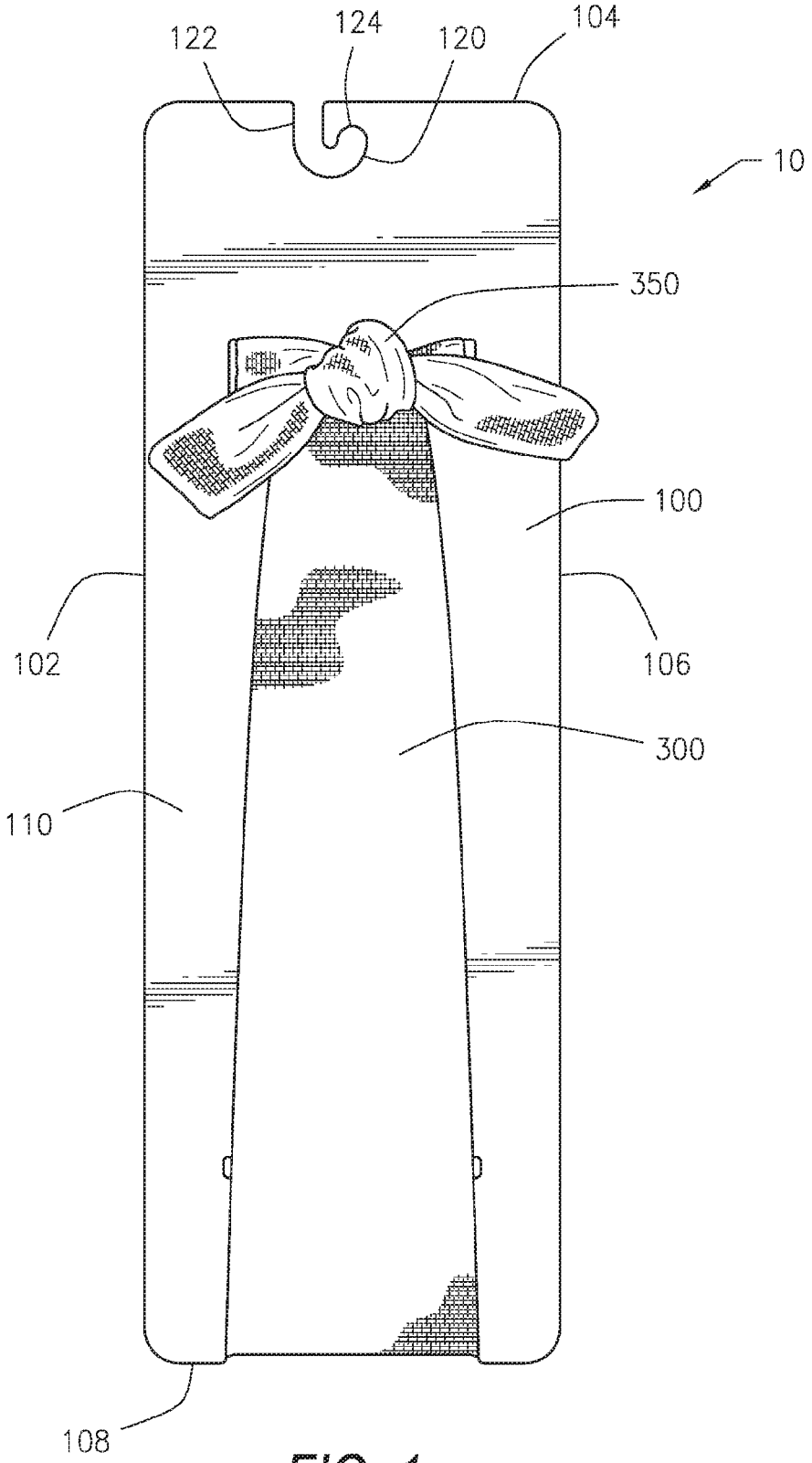
FIG. 1 is a perspective view of a complete cloth band tie card and installed band in accordance with the present invention.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to an improved cloth band tie card and method. In accordance with one exemplary embodiment of the present invention, a tie-on-band display is provided using a tie card for mounting a cloth band such as a headband, scarf, or other elongated flexible object. The unique structure of the tie card of the present invention presents the band in a flat configuration with an ornamental tie knot. The device and method may use a base card forming a post and rail construction utilizing separated slots for compact spreading of headband material in a doubled elongated flat configuration providing non-wrinkling compacted storage, shipping, and display of the headband.

As shown in FIGS. 1 through 11 of the drawings, one exemplary embodiment of the present invention is generally shown as a tie-on-band display 10. The tie-on-flexible band display 10 may use a tie card 100 for mounting a flexible band 300. The unique structure of the tie card 100 of the present invention may present the flexible band 300 in a flat configuration with an ornamental tie knot 350.

The tie card 100 may provide the hanging and mounting base. The tie card 100 may have a left card side 102, card top 104, right card side 106, card bottom 108, card front 110, and card back 112. The tie card 100 may include a hanging aperture 120 for hanging on a horizontal rod or projection. The hanging aperture may include an access neck 122 leading to an upper gravity notch 124 or may be a circular or other shaped opening. The tie card 100 may also include a first side aperture 130, upper mid aperture 150, second side aperture 170, lower mid aperture 190, and bottom aperture 210 defining a first post 140, second post 160, mid rail 180, and bottom rail 200 for installation of the flexible band 300.

The flexible band 300 may be a headband, as shown, or a scarf, sock, legging, band, collapsing hose, or other elongated flexible item. The flexible band 300 may be constructed with an elongated band body 302 having a first band end 304 and a second band end 306. The elongated band body 302 may also include a band midpoint 308 and a left band side 310 and right band side 312.

The flexible band 300 may be affixed to the tie card 100 at the top and bottom of the tie card 100. As shown in the drawings, the flexible band 300 may be tied at the top of the tie card 100 using a first side aperture 130 separated by a first post 140 from an upper mid aperture 150, which may be separated by a second post from a second side aperture 170. The top of the tie card 100 may be separated from the bottom of the tie card 100 by the mid rail 180. The flexible band 300 may then be woven into the bottom of the tie card 100 using the mid rail 180 and the lower mid aperture 190 along with the bottom rail 200 and the bottom aperture 210.

The first side aperture 130 may be constructed as a left vertical slot 131. The left vertical slot 131 may be shaped using a left outer edge 132, left top edge 134, left inner edge 136, and left bottom edge 138.

The first post 140 may be a left post formed between the left inner edge 136 of the first side aperture 130 and the upper mid left edge 152 of the upper mid aperture 150.

The upper mid aperture 150 may be formed as an upper horizontal slot 151. The upper horizontal slot 151 may be shaped with an upper mid left edge 152, upper mid top edge 154, upper mid right edge 156, and upper mid bottom edge 158.

The second post 160 may be a right post formed between the upper mid right edge 156 of the upper mid aperture 150 and the right inner edge 176 of the second side aperture 170.

The second side aperture 170 may be a right vertical slot 171 formed with a right outer edge 172, right top edge 174, right inner edge 176, and right bottom edge 178.

The mid rail 180 may be positioned between the upper mid aperture 150 and the lower mid aperture 190.

The lower mid aperture 190 may be formed as a lower horizontal slot 191 with a lower left edge 192, lower top edge 194, lower right edge 196, and lower bottom edge 198.

The bottom rail 200 may be positioned between the lower mid aperture 190 and the bottom aperture 210.

The bottom aperture 210 may be constructed as a bottom edge notch 211. The bottom edge notch may have a bottom left edge 212, bottom top edge 214, and bottom right edge 216.

Figure 2:
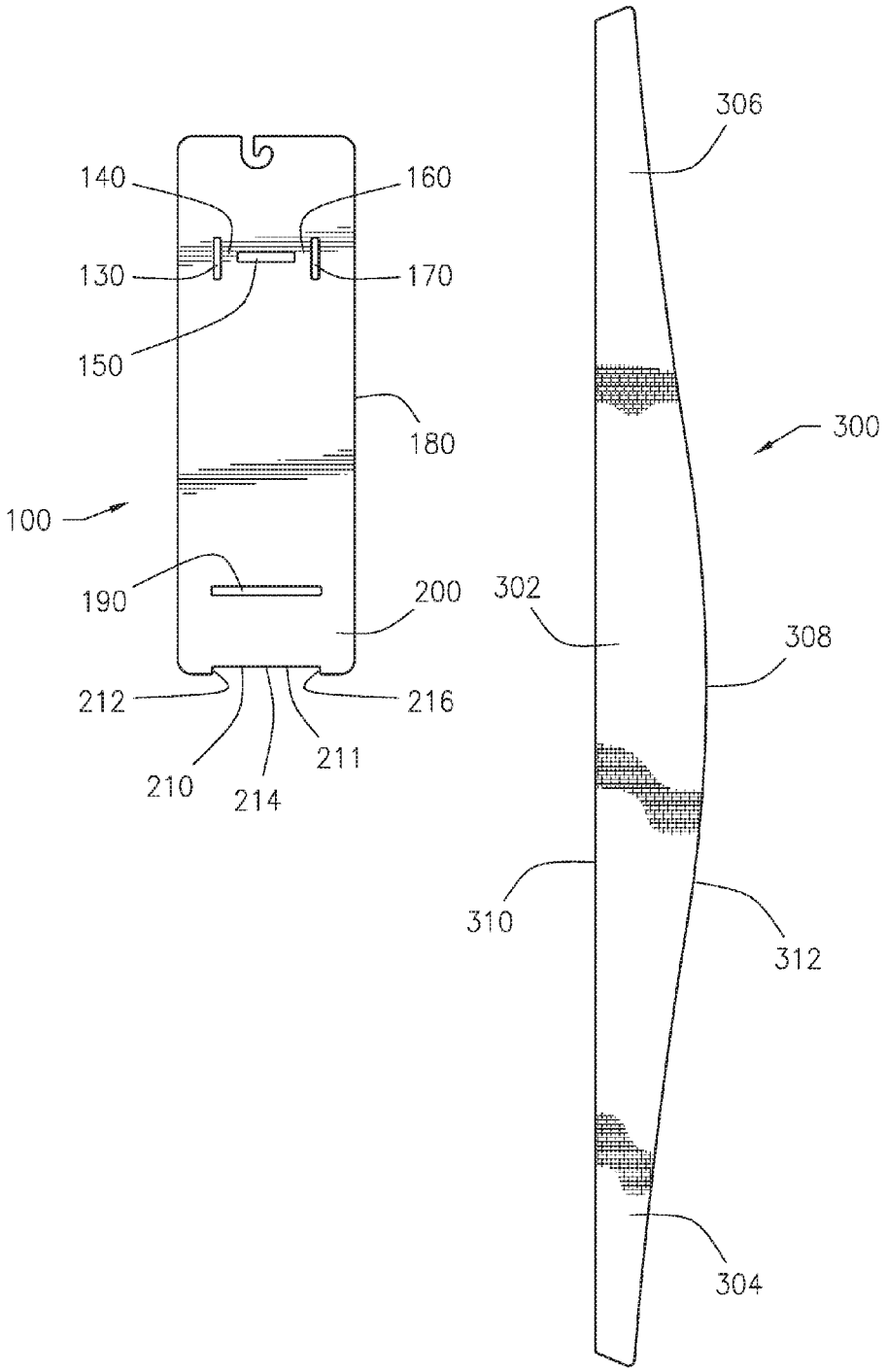
FIG. 2 is a schematic view of a tie card positioned next to an elongated band.
Figure 3:
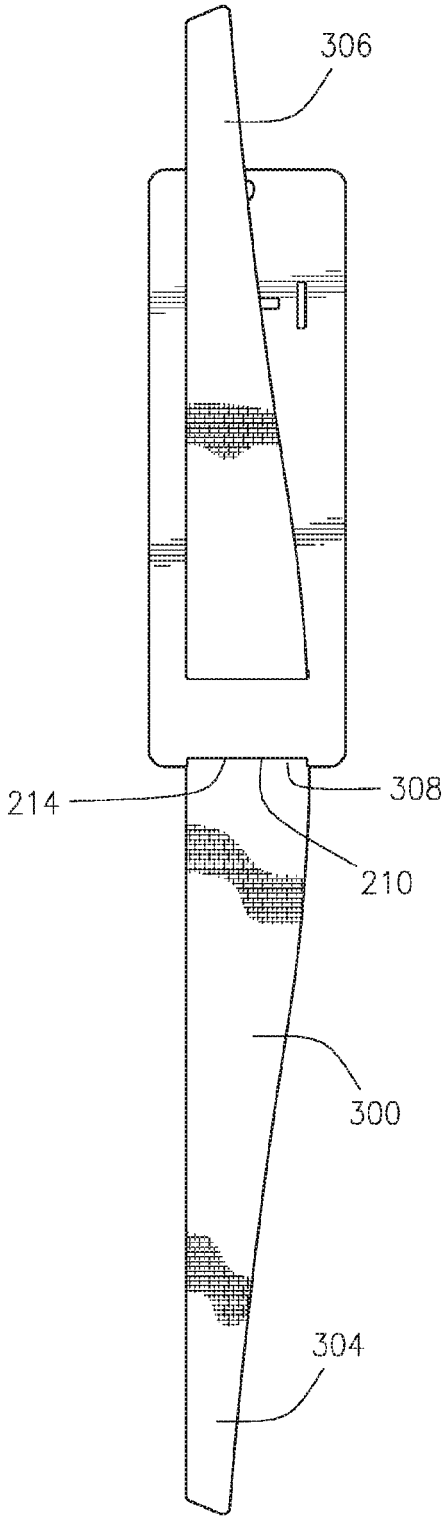
FIG. 3 is a schematic view of the band positioned through the lower horizontal slot.
Figure 4:
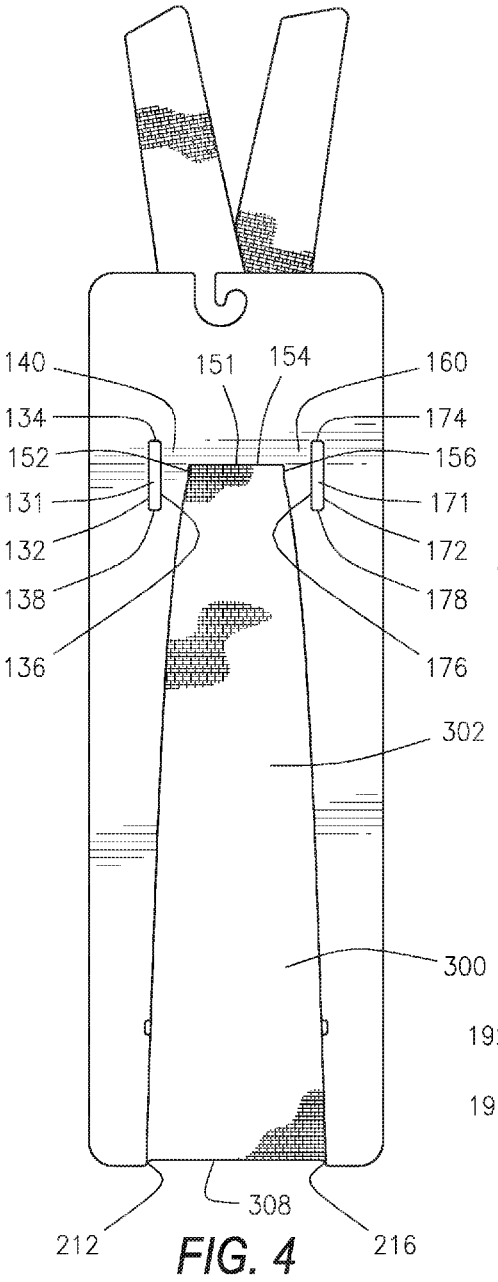
FIG. 4 is a schematic view of the band folded over the bottom rail and the ends positioned through the upper mid aperture.
Figure 5:
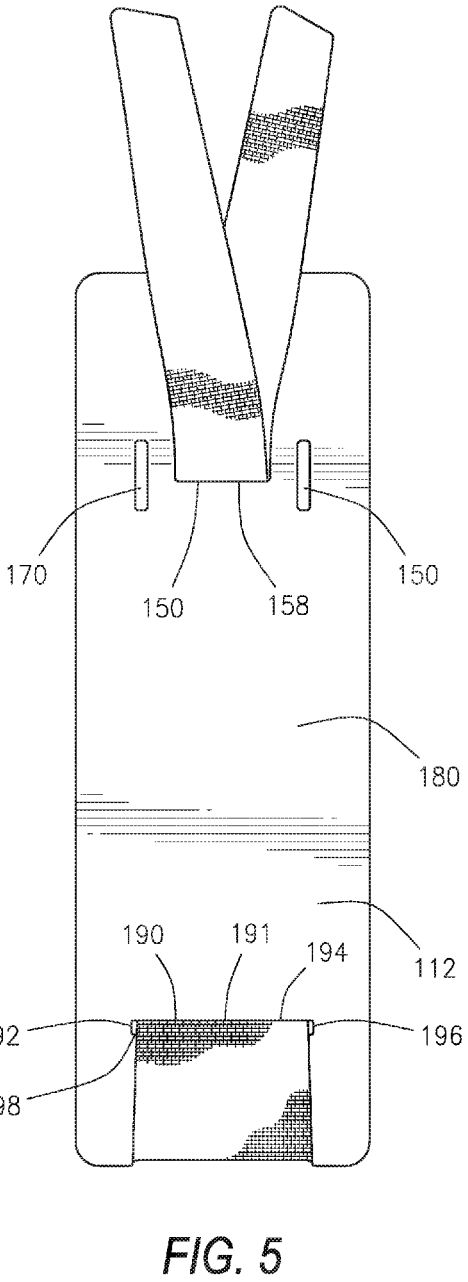
FIG. 5 is a schematic view of the back of the card showing how the band is folded around the back of the bottom rail.

As seen in FIGS. 2 through 4, to install the flexible band 300 on the tie card 100, the flexible band 300 may be folded around the bottom aperture 210 at the midpoint 308 with the first band end 304 on the card front 110 of the tie card 100 and the second band end 306 on the card back 112 of the tie card 100. As best seen in FIG. 3, the second band end 306 may be inserted from back to front through the lower mid aperture 190 so that the band 300 captures the bottom rail 200, as shown in FIG. 5. The tie card 100, including the bottom rail 200, may be constructed from flat cardstock, allowing the flexible band 300 to lay flat. In this manner, the midpoint 300 of the flexible band 300 may be tensioned against the bottom edge 214 and the body 302 may be laid flat against the front and back of the card 100 and held in position by the edges 212 and 216.

As shown in FIGS. 4 and 5, both the first band end 304 and the second band end 306 may be then inserted from front to back through the upper mid aperture 150 such that the flexible band 300 passes in front of the mid rail 180. Once again, the flat construction of the mid rail 180 may allow the flexible band 300 to lay flat.

Figure 6:
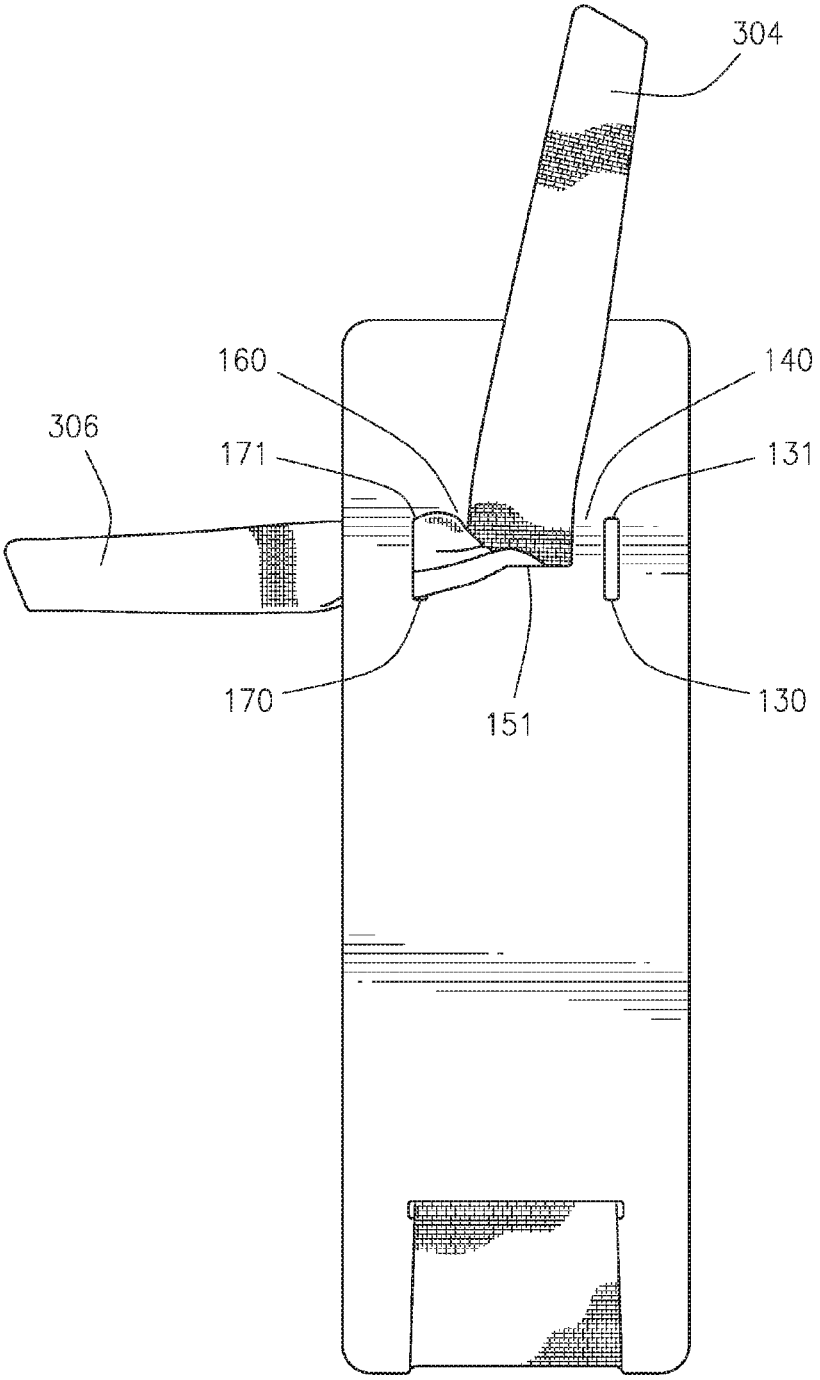
FIG. 6 is a back schematic view showing an end inserted one of the side apertures.
Figure 7:
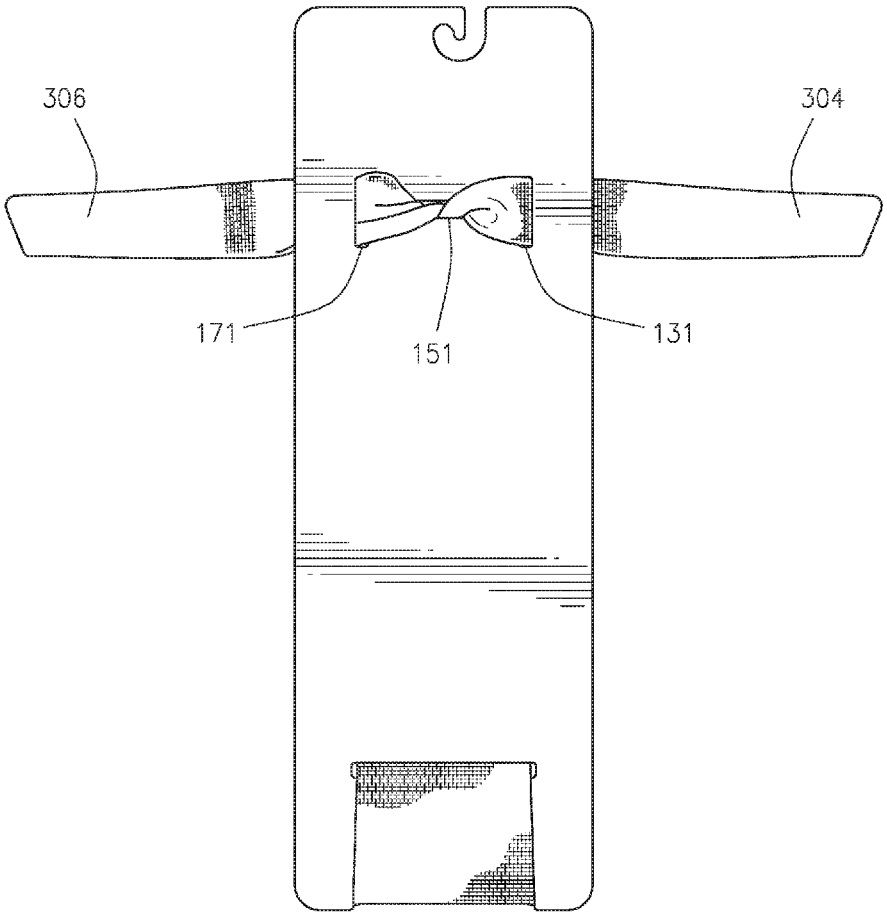
FIG. 7 is a back schematic view showing both ends inserted through the side apertures.
Figure 8:
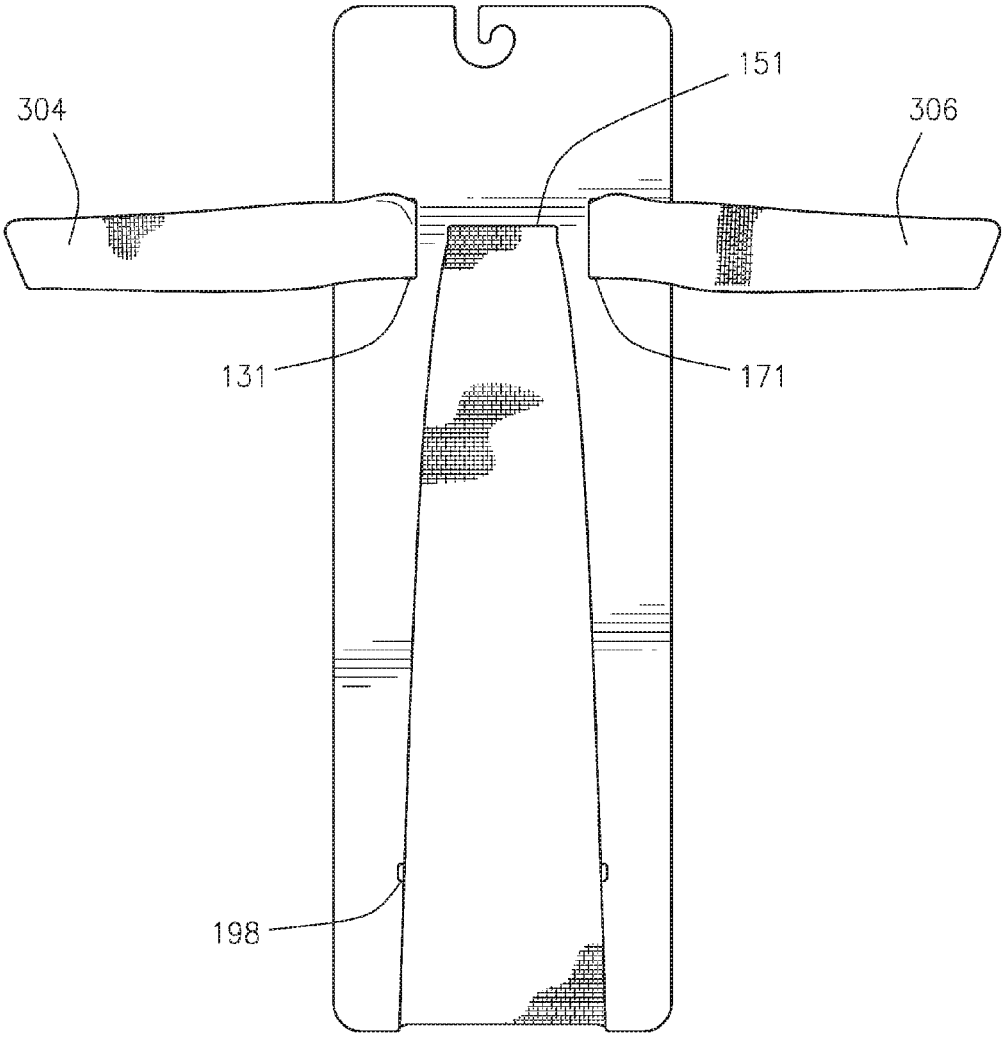
FIG. 8 is a front schematic view showing both ends inserted through the side apertures.

A shown in FIG. 6, the second end 306 may be then folded ninety degrees and inserted back to front through the second side aperture 170 such that it passes around the back of the second post 160. As shown in FIGS. 7 and 8, the first end 304 may be similarly folded ninety degrees in the opposite direction and inserted back to front through the first side aperture 130 such that it passes around the back of the first post 140. The configuration of slots 131, 151, and 171 may help to keep the flexible band 300 relatively flat.

Figure 9:
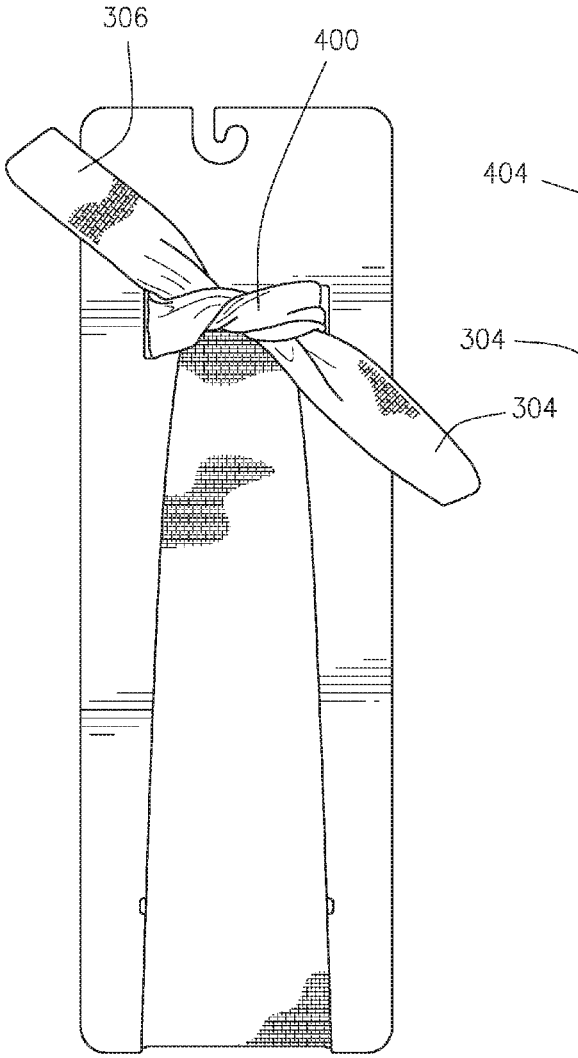
FIG. 9 is a front schematic view showing the ends tied in a half knot.
Figure 10:
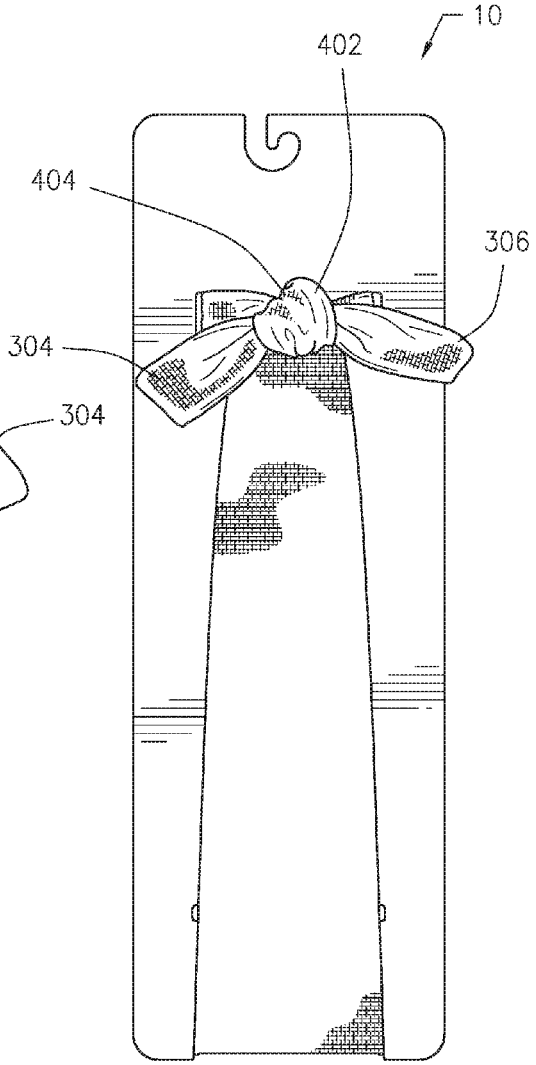
FIG. 10 is a front schematic view showing the ends tied in a full knot for final construction.
Figure 11:
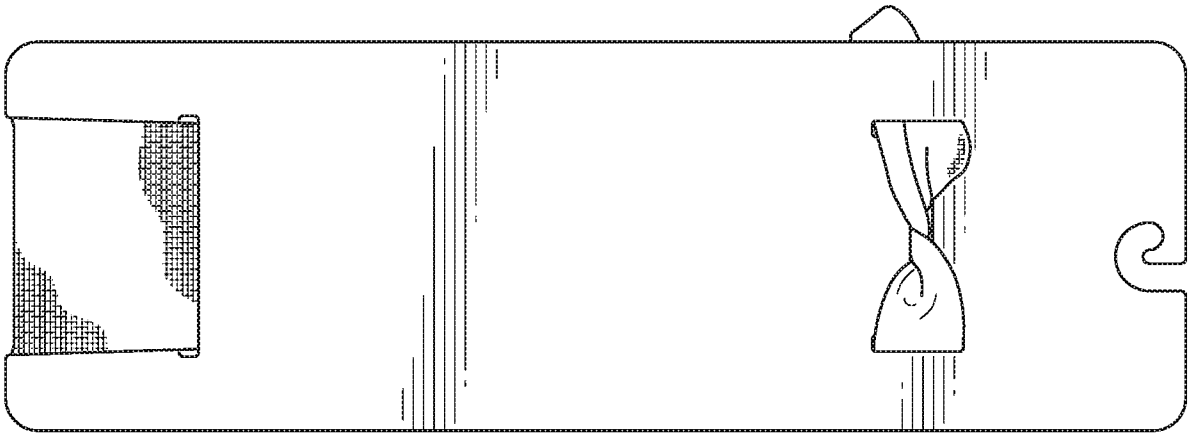
FIG. 11 is a back schematic view showing the back completed construction.

As shown in FIGS. 9 and 10, the first and second band ends 304 and 306 may then be tied in a first half knot 400 and second half knot 402 to form a square knot 404 with the ends 304 and 306 forming decorative tails dangling from the square knot 404. As shown in FIGS. 10 and 11, forming the apertures 210, 190, 150, 170, and 130 as slots 211, 191, 151, 171, and 131 may allow the flexible band 300 to lay flat against the card 100 except for the bulk of the flat-natured square knot 404. The slots 211, 191, 151, 171, and 131 are shown positioned at ninety degree angles from the vertical to horizontal, but these can be varied to achieve different effects on the appearance.

It will be appreciated that the present invention provides a combination storage and display device for a cloth band.

Whereas, the devices and methods have been described in relation to the drawings and claims, it should be understood that other and further modifications, apart from those shown or suggested herein, may be made within the spirit and scope of this invention.

What is claimed is:

1. A display card for displaying a flexible band, the display card comprising:

a front, a back, a top, a bottom, a right side, and a left side;

a first side aperture;

an upper mid aperture;

a second side aperture;

a lower mid aperture;

a first post, where the first post is located between and defined by the first side aperture and the upper mid aperture;

a second post, where the second post is located between and defined by the second side aperture and the upper mid aperture;

a mid rail, where the mid rail is located between and defined by the upper mid aperture and the lower mid aperture;

a bottom rail, where the bottom rail is located between the lower mid aperture and the bottom; and the flexible band and the flexible band is elongate and has a first end, a second end, and a midpoint located midway between the first end and the second end; the midpoint of the flexible band is located at the bottom; the first end and the second end are tied in a knot located between the first side aperture and the second side aperture and in front of the upper mid aperture.

2. The display card of claim 1 where the first side aperture and the second side aperture are each vertically elongate and where the first side aperture is parallel to the second side aperture.

3. The display card of claim 2 where the first side aperture and the second side aperture are parallel to the right side and the left side.

4. The display card of claim 2 where:

the first side aperture is located closer to the left side than to the right side;

the second side aperture is located closer to the right side than to the left side; and the upper mid aperture is horizontally elongate and is located between the first side aperture and the second side aperture, where the upper mid aperture is separated from the first side aperture by the first post and the upper mid aperture is separated from the second side aperture by the second post.

5. The display card of claim 4 where the first side aperture, the second side aperture, and the upper mid aperture are located closer to the top than to the bottom.

6. The display card of claim 1 where the upper mid aperture and the lower mid aperture are each horizontally elongate and where the upper mid aperture is parallel to the lower mid aperture.

7. The display card of claim 6 where the upper mid aperture and the lower mid aperture are parallel to the top and the bottom.

8. The display card of claim 6 where the upper mid aperture is located closer to the top than to the bottom and the lower mid aperture is located closer to the bottom than to the top.

9. The display card of claim 6 where the upper mid aperture and the lower mid aperture are centered relative to the right side and the left side.

10. The display card of claim 1 further comprising a bottom aperture, where the bottom rail is located between and defined by the lower mid aperture and the bottom aperture.

11. The display card of claim 10 where the bottom aperture is a notch in the bottom.

12. The display card of claim 1 further comprising a hanging aperture located between the upper mid aperture and the top.

13. The display card of claim 1 where:

the flexible band wraps around the bottom rail, passes through the bottom mid aperture, passes in front of the mid rail, passes through the upper mid aperture, wraps around the first post and the second post, and passes through the first side aperture and the second side aperture; and.

14. A display card for displaying a flexible band, the display card comprising:

a front, a back, a top, a bottom, a right side, and a left side;

a first side aperture and a second side aperture, where the first side aperture and the second side aperture are each vertically elongate, where the first side aperture is parallel to the second side aperture, where the first side aperture is located closer to the left side than to the right side, and where the second side aperture is located closer to the right side than to the left side;

an upper mid aperture, where the upper mid aperture is horizontally elongate, where the upper mid aperture is located between the first side aperture and the second side aperture, and where the upper mid aperture, the first side aperture, and the second side aperture are located closer to the top than to the bottom;

a lower mid aperture, where the lower mid aperture is horizontally elongate, where the lower mid aperture is parallel to the upper mid aperture, and where the lower mid aperture is located closer to the bottom than to the top;

a first post, where the first post is located between and defined by the first side aperture and the upper mid aperture;

a second post, where the second post is located between and defined by the second side aperture and the upper mid aperture;

a mid rail, where the mid rail is located between and defined by the upper mid aperture and the lower mid aperture;

a bottom rail, where the bottom rail is located between the lower mid aperture and the bottom; the flexible band and the flexible band is elongate and has a first end, a second end, and a midpoint located midway between the first end and the second end; the midpoint of the flexible band is located at the bottom; the first end and the second end are tied in a knot located between the first side aperture and the second side aperture and in front of the upper mid aperture; and the flexible band.

15. The display card of claim 14 where:

the flexible band wraps around the bottom rail, passes through the bottom mid aperture, passes in front of the mid rail, passes through the upper mid aperture, wraps around the first post and the second post, and passes through the first side aperture and the second side aperture; and.

16. A method of displaying a flexible band on a display card, where:

the display card comprises:

a front, a back, a top, a bottom, a right side, and a left side;

a first side aperture;

an upper mid aperture;

a second side aperture;

a lower mid aperture;

a bottom aperture;

a first post, where the first post is located between and defined by the first side aperture and the upper mid aperture;

a second post, where the second post is located between and defined by the second side aperture and the upper mid aperture;

a mid rail, where the mid rail is located between and defined by the upper mid aperture and the lower mid aperture; and a bottom rail, where the bottom rail is located between the lower mid aperture and the bottom; and the flexible band is elongate and has a first end, a second end, and a midpoint located midway between the first end and the second end;

the method comprising:

passing the first end through the lower mid aperture from back to front;

pulling the first end until the midpoint is adjacent the bottom;

passing the first end and the second end through the upper mid aperture from front to back;

passing the first end through the first side aperture from back to front and passing the second end through the second side aperture from back to front, or passing the first end through the second side aperture from back to front and passing the second end through the first side aperture from back to front; and tying the first end and the second end together.

17. The method of claim 16 where passing the first end and the second end through the upper mid aperture from front to back further comprises pulling the first end and the second end simultaneously until the flexible band is taught and lies flat in front of the mid rail.

18. The method of claim 16 further comprising placing the first end to the left of the display card prior to passing the first end through the first side aperture from back to front such that the flexible band folds 90° behind the first post.

19. The method of claim 16 further comprising placing the second end to the right of the display card prior to passing the second end through the second side aperture from back to front such that the flexible band folds 90° behind the second post.

20. The method of claim 16 where tying the first end and the second end together comprises forming a square knot in front of the upper mid aperture.

21. A display apparatus for displaying a flexible band, the display apparatus comprising:

a first side aperture;

an upper mid aperture;

a second side aperture;

a lower mid aperture;

a bottom aperture;

a first post, where the first post is located between and defined by the first side aperture and the upper mid aperture;

a second post, where the second post is located between and defined by the second side aperture and the upper mid aperture;

a mid rail, where the mid rail is located between and defined by the upper mid aperture and the lower mid aperture; and a bottom rail, where the bottom rail is located beneath the lower mid aperture; and the flexible band, where:

the flexible band is elongate and has a first end, a second end, and a midpoint located midway between the first end and the second end;

the flexible band wraps around the bottom rail, passes through the bottom mid aperture, passes in front of the mid rail, passes through the upper mid aperture, wraps around the first post and the second post, and passes through the first side aperture and the second side aperture; and the first end and the second end are tied in a knot located between the first side aperture and the second side aperture and in front of the upper mid aperture.

22. The display apparatus of claim 21 where the first side aperture and the second side aperture are each vertically elongate and where the first side aperture is parallel to the second side aperture.

* * * * *